US012799562B2

(12) United States Patent
Kim et al.

(10) Patent No.: US 12,799,562 B2
(45) Date of Patent: Nov. 17, 2026

(54) METHOD FOR MANUFACTURING A HIGH-PURITY NICKEL/COBALT MIXED SOLUTION FOR A CATHODE MATERIAL BY A TWO CIRCUIT PROCESS

(71) Applicant: POSTECH Research and Business Development Foundation, Pohang-si (KR)

(72) Inventors: Yong Tae Kim, Pohang-si (KR); Go Gwon Choe, Pohang-si (KR)

(73) Assignee: POSTECH RESEARCH AND BUSINESS DEVELOPMENT FOUNDATION, Pohang-si (KR)

( * ) Notice: Subject to any disclaimer, the term of this patent is extended or adjusted under 35 U.S.C. 154(b) by 447 days.

(21) Appl. No.: 17/885,676

(22) Filed: Aug. 11, 2022

(65) Prior Publication Data

US 2023/0227938 A1 Jul. 20, 2023

(30) Foreign Application Priority Data

Jan. 20, 2022 (KR) ..... 10-2022-0008271

(51) Int. Cl.
*C22B 3/00* (2006.01)
*C22B 3/44* (2006.01)

(52) U.S. Cl.
CPC ..... *C22B 23/0461* (2013.01); *C22B 3/44* (2013.01)

(58) Field of Classification Search
CPC ..... C22B 23/0461; C22B 3/44; H01M 10/54; Y02P 10/20
See application file for complete search history.

(56) References Cited

U.S. PATENT DOCUMENTS

2004/0050212 A1* 3/2004 Cheng ..... C22B 3/3842 75/722
2021/0354997 A1* 11/2021 Osten ..... C22B 23/0461

FOREIGN PATENT DOCUMENTS

CN 108004419 A * 5/2018 ..... C22B 3/3844
KR 10-1535250 7/2015
(Continued)

OTHER PUBLICATIONS

Chang, Jun, et al. "Impure ions removal from multicomponent leach solution of nickel sulfide concentrates by solvent extraction in impinging stream rotating packed bed." Chemical Engineering and Processing-Process Intensification 137 (2019): 54-63. (Year: 2019).*
(Continued)

*Primary Examiner* — Rebecca Janssen
*Assistant Examiner* — Mayela Aldaz
(74) *Attorney, Agent, or Firm* — LEX IP MEISTER, PLLC

(57) ABSTRACT

A method for manufacturing a high-purity nickel/cobalt mixed solution for cathode materials by using a two-circuit process is provided, wherein the two-circuit process extracts cobalt and nickel in a simultaneous manner and prepares a Ni/Co mixed solution, thereby reducing the investment cost for the manufacturing process and downsizing mixer-settler facilities to maximize the efficiency of site utilization. The method skips the crystallization process by using the two-circuit process, so it is possible to solve the problem of increasing the unit product cost due to the additional process cost, prevent an increase in the consumption of the adjuster solution in each mixer-setter tank for pH adjustment and the process costs, and realize eco-friendly effects, such as cutting down the production of the process wastewater.

8 Claims, 17 Drawing Sheets

(56) References Cited

FOREIGN PATENT DOCUMENTS

| | | | | |
|---|---|---|---|---|
| KR | 10-2152923 | 9/2020 | | |
| WO | WO-2020061639 A1 * | 4/2020 | ..... | C01G 53/10 |

OTHER PUBLICATIONS

English machine translation of CN108004419A of Zhao (Year: 2018).*

Jones, D. L., McCoy, T. M., Mayhew, K. E., Cheng, C. Y., Barnard, K. R., & Zhang, W. (May 2010). A new process for cobalt-nickel separation. In Alta Nickel/Cobalt Forum (pp. 1-19). Victoria: Australia Alta Metallurgical services. (Year: 2010).*

Choe, G., Lim, Y. J., Kim, Y., Lee, G. G., & Kim, Y. T. (2023). Simplified solvent extraction process for high-purity Ni/Co mixed solution for lithium-ion batteries. Separation Science and Technology, 58(12), 2115-2122. (Year: 2023).*

* cited by examiner

METHOD FOR MANUFACTURING A HIGH-PURITY NICKEL/COBALT MIXED SOLUTION FOR A CATHODE MATERIAL BY A TWO CIRCUIT PROCESS

FIELD OF THE INVENTION

The present invention relates to a method for manufacturing a high-purity nickel/cobalt mixed solution for cathode materials by using a two-circuit process. More particularly the present invention relates to a method for manufacturing a high-purity Ni/Co mixed solution for cathode materials by using a two-circuit process that skips the crystallization process unlike the conventional three-circuit process of impurity extraction, cobalt (Co) extraction and nickel (Ni) extraction, adopts a two-circuit process to extract cobalt and nickel in a simultaneous manner, and prepare a Ni/Co mixed solution. Accordingly, the efficiency of site utilization can be maximized by reducing the investment cost for the manufacturing process and downsizing mixer-settler facilities. Further, eco-friendly effects such as reducing the consumption of adjuster solutions and cutting down the process costs and the process wastewater production can be realized. This research was supported by Creative Materials Discovery Program through the National Research Foundation of Korea (NRF) funded by Ministry of Science and ICT (2019M3D1A1079306)

BACKGROUND OF THE INVENTION

Due to the rapid increase in the use of fossil fuels, the demand for alternative energy or clean energy is on the rise. As part of that, research in the field of electrochemical energy is being actively conducted, and, particularly, the need for lithium secondary battery technology is increasing.

A variety of materials are used as cathode materials for lithium secondary batteries, and among others, $LiNi_xCo_yMn_zO_2$ (NCM, x+y+z=1) had the highest market share due to its high energy density. Nickel and cobalt are key raw materials in the fabrication of the NCM cathode material.

Meanwhile, the solvent extraction process consisting of three processing steps of extraction, scrubbing and stripping is widely used in the smelting process for nickel and cobalt. In particular, the solvent extraction process of nickel sulfide and cobalt sulfide generally consists of a three-circuit process of impurity extraction, cobalt extraction and nickel extraction.

The traditional three-circuit process is, however, much problematic to require multi-stage mixer-setter tanks with 45 to 60 stages, resulting in a rise of the required size of the facility site and the initial investment costs for the process, and increase the consumption of the adjuster solution for pH adjustment of each mixer-setter tank, the process consumption cost and the process wastewater production. On top of that, an addition of the crystallization process may incur an additional cost of the process and consequently a rise of the unit product cost.

Accordingly, there is an urgent need to develop techniques that may meet the needs for low-cost, eco-friendly lithium secondary batteries and cathode materials thereof that have rapidly increased in recent years. Disclosures such as KR10-2152923 or KR10-1535250 have been proposed as exemplary techniques, but no disclosure has yet been found to present a solution to the above-mentioned problems.

In an attempt to solve the problems, the inventors of the present invention have completed the present invention that prepares a nickel/cobalt (Ni/Co) mixed solution by skipping a crystallization process and adopting a two-circuit process to extract cobalt and nickel in a simultaneous manner rather than using the traditional three-circuit process of impurity extraction, cobalt extraction and nickel extraction, thereby reducing the investment cost for the manufacturing process, downsizing mixer-settler facilities to maximize the efficiency of site utilization, and realizing eco-friendly effects, such as reducing the consumption of adjuster solutions and cutting down the process costs and the process wastewater production.

SUMMARY OF THE INVENTION

Technical Problem

It is an object of the present invention to provide a method for manufacturing a high-purity nickel/cobalt mixed solution for a cathode material by using a two-circuit process that involves extracting nickel and cobalt in a simultaneous manner using a two-circuit process to prepare a nickel/cobalt mixed solution, thereby removing the problem with the traditional three-circuit process that requires multi-stage mixer-setter tanks with 45 to 60 stages and leads to an increase in the scale of the facility site and the initial investment cost for the process.

It is another object of the present invention to provide a method for manufacturing a high-purity nickel/cobalt mixed solution for a cathode material by using a two-circuit process that skips the crystallization process and thereby solves the problem of increasing the unit product cost due to the additional process cost.

It is still another object of the present invention to provide a method for manufacturing a high-purity nickel/cobalt mixed solution for a cathode material by using a two-circuit process that prevents an increase in the consumption of the adjuster solution in each mixer-setter tank for pH adjustment and the process costs and realizes eco-friendly effects, such as cutting down the production of the process wastewater.

All the above and other objects of the present invention can be achieved by the present invention given in the following description.

Technical Solution

In one aspect of the present invention, there is provided a method for manufacturing a high-purity nickel/cobalt mixed solution for cathode materials by using a two-circuit process, the method comprising: (a) a first circuit extraction process of extracting impurities other than magnesium (Mg) in an organic phase from a sulfide containing nickel, cobalt and magnesium using a first extraction agent at a given value of pH; (b) a first circuit scrubbing process of stirring the extracted organic phase along with distilled water to recover the extracted nickel and cobalt in an aqueous phase; (c) a first circuit stripping process of recovering impurities contained in the first extraction agent in an aqueous phase; (d) a second circuit extraction process of saponifying a second extraction agent for separation of magnesium of the first circuit process and extracting nickel, cobalt and manganese in an organic phase; (e) a second circuit scrubbing process of stirring the organic phase from the second circuit extraction process along with distilled water and recovering the extracted magnesium in an aqueous phase; and (f) a second circuit stripping process of recovering the extracted nickel and cobalt in an aqueous phase and productizing into a mixed liquid form.

In an embodiment, the first circuit extraction process may be performed at pH 3.4 to 3.6, with an organic/aqueous (O/A) ratio being 1.7 to 1.9.

In an embodiment, the first circuit scrubbing process may be performed at pH 2.9 to 3.1, with an organic/aqueous (O/A) ratio being 4.9 to 5.1.

In an embodiment, the first circuit stripping process may be performed using 13 to 17 wt. % of sulfuric acid ($H_2SO_4$) in an aqueous phase, with an organic/aqueous (O/A) ratio being 4.9 to 5.1.

In an embodiment, the second circuit extraction process may be performed at pH 6.2 to 6.4, with an organic/aqueous (O/A) ratio being 3.7 to 3.8.

In an embodiment, the second circuit scrubbing process may be performed at pH 6.1 to 6.3, with an organic/aqueous (O/A) ratio being 4.9 to 5.1.

In an embodiment, the second circuit stripping process may be performed using 25 to 35 wt. % of sulfuric acid ($H_2SO_4$) in an aqueous phase, with an organic/aqueous (O/A) ratio being 4.9 to 5.1.

In an embodiment, the second circuit stripping process may be performed at a process temperature of 55 to 65 °C.

In an embodiment, the first extraction agent may be bis(2-ethylhexyl)phosphate (D2EHPA, di-2-ethylhexylphosphoric acid), and the second extraction agent may be versatic acid (VA-10, Versatic Acid-10).

Effects of Invention

The method for manufacturing a high-purity nickel/cobalt mixed solution for cathode materials by using a two circuit process according to the present invention skips the crystallization process unlike the conventional three-circuit process of impurity extraction, cobalt (Co) extraction and nickel (Ni) extraction and adopts a two-circuit process to extract cobalt and nickel in a simultaneous manner and prepare a nickel/cobalt mixed solution, thereby reducing the investment cost for the manufacturing process, downsizing mixer-settler facilities to maximize the efficiency of site utilization, and realizing eco-friendly effects, such as reducing the consumption of adjuster solutions and cutting down the process costs and the production of the process wastewater.

DETAILED DESCRIPTION OF THE EMBODIMENTS

Figure 1:
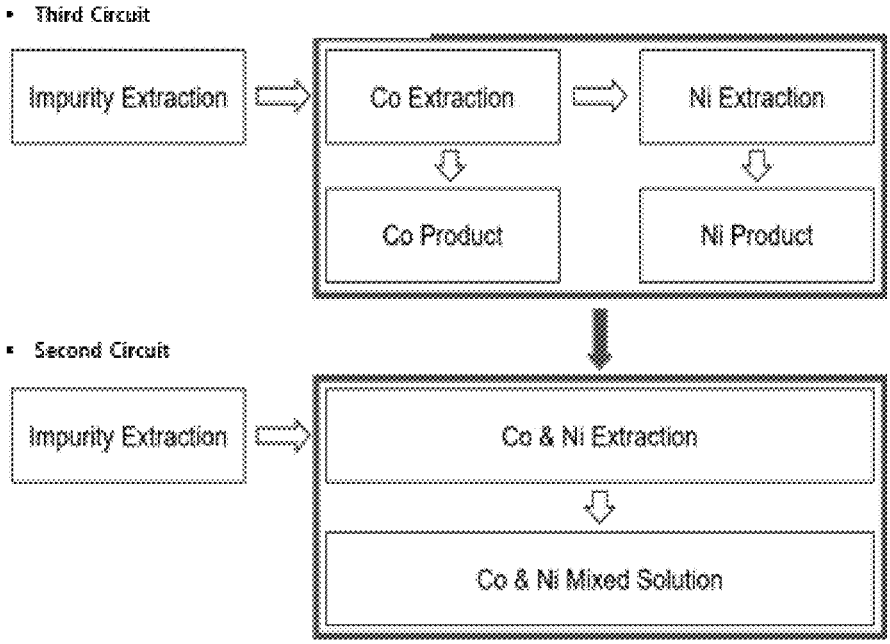
FIG. 1 is a schematic diagram showing a comparison between a method for manufacturing a nickel/cobalt mixed solution using a conventional three-circuit process and a method for manufacturing a nickel/cobalt mixed solution using a two-circuit process according to an embodiment of the present invention.

Hereinafter, embodiments of the present invention will be described in further detail with reference to the accompanying drawings. The technology disclosed in the present invention is not limited to the embodiments described herein and may be embodied in other forms. But, the embodiments disclosed herein are provided so that the disclosed content can be thorough and complete, and so that the spirit of the present invention can be readily conveyed to those skilled in the art. In the drawings, the dimensions such as width and thickness of the components are slightly enlarged in order to clearly express the components of each device.

In addition, although only some of the components are illustrated for convenience of description, those skilled in the art will be able to easily grasp the remaining parts. In the description of the drawings as a whole, it has been described from an observer's point of view. When an element is referred to as being positioned on or under another element, it means that the element is positioned directly on or under another element, or any other element exists between these two elements.

In addition, those of ordinary skill in the art will be able to implement of the spirit of the present invention in various other forms within the scope not departing from the technical spirit of the present invention. In the plurality of drawings, the same reference numerals are assigned to the elements that are substantially the same as each other.

The singular forms are intended to include the plural forms as well, unless the context clearly indicates otherwise. It will be further understood that the terms "comprises" and/or "has" used herein specify the presence of stated feature, number, step, operation, component, element, part, or a combination thereof but do not preclude the presence or addition of one or more other features, numbers, steps, operations, components, elements, parts, or combinations thereof.

In addition, in performing the method or the manufacturing method, each process constituting the method may occur differently from the specified order unless the specific order is clearly described in context. In other words, each process may occur in the same order as specified or may be performed substantially in a simultaneous manner or in the reverse order.

Hereinafter, the present invention will be described in further detail.

FIG. 1 is a schematic diagram showing a comparison between a method for manufacturing a nickel/cobalt mixed solution using a conventional three-circuit process and a method for manufacturing a nickel/cobalt mixed solution using a two-circuit process according to an embodiment of the present invention.

Referring to FIG. 1, a solvent extraction process for extracting nickel and cobalt from a sulfide according to a prior invention consists of a three-circuit process of impurity extraction, cobalt extraction and nickel extraction and involves a step of crystallizing the separated nickel and cobalt into crystals of nickel sulfate and cobalt sulfates. On the flip side, a process for preparing a nickel/cobalt mixed solution using a two-circuit process according to an embodiment of the present invention involves extracting cobalt and nickel simultaneously using a three-circuit process and skips a crystallization process.

The solvent extraction process of smelting nickel and cobalt separates elements of interest from a mixed solution containing impurities using the difference between separation factors of solvent extraction agents. This process may consist of three processing steps of extraction, scrubbing and stripping and optionally include saponification.

The solvent extraction process uses the distribution coefficient, also referred to as the organic/aqueous (O/A) ratio, that is the ratio of concentrations of each metal ion in the organic phase (a solvent extraction agent, extractant) and the aqueous phase at thermodynamic equilibrium. The distribution coefficient is different for each metal, so the separation factor that is in proportion to the distribution coefficient can be used to selectively purify a metal of interest in a mixed solution containing a mixture of the metal of interest and impurities.

In the solvent extraction process, the pH is altered to modify the distribution coefficient and the separation factor. The pH adjustment is achieved using an acidic or alkaline pH adjuster, and the consumption of the pH adjuster solution can be minimized through reduction of the degree of pH adjustment.

Using the two-circuit process of the present invention, it is possible to overcome the limitation of the prior inventions, thus downsizing the mixer-setter facilities to maximize the efficiency of site utilization and realizing eco-friendly effects, such as reducing the consumption of adjuster solutions and cutting down the process costs and the production of the process wastewater.

Method for Manufacturing High-Purity Ni/Co Mixed Solution for Cathode Material by Two-Circuit Process As one aspect of the present invention, the preparation method for a high-purity nickel/cobalt mixed solution for cathode materials by using a two-circuit process consists of a first circuit extraction process, a first circuit scrubbing process, a first circuit stripping process, a second circuit extraction process, a second circuit scrubbing process, and a second circuit stripping process.

Figure 2:
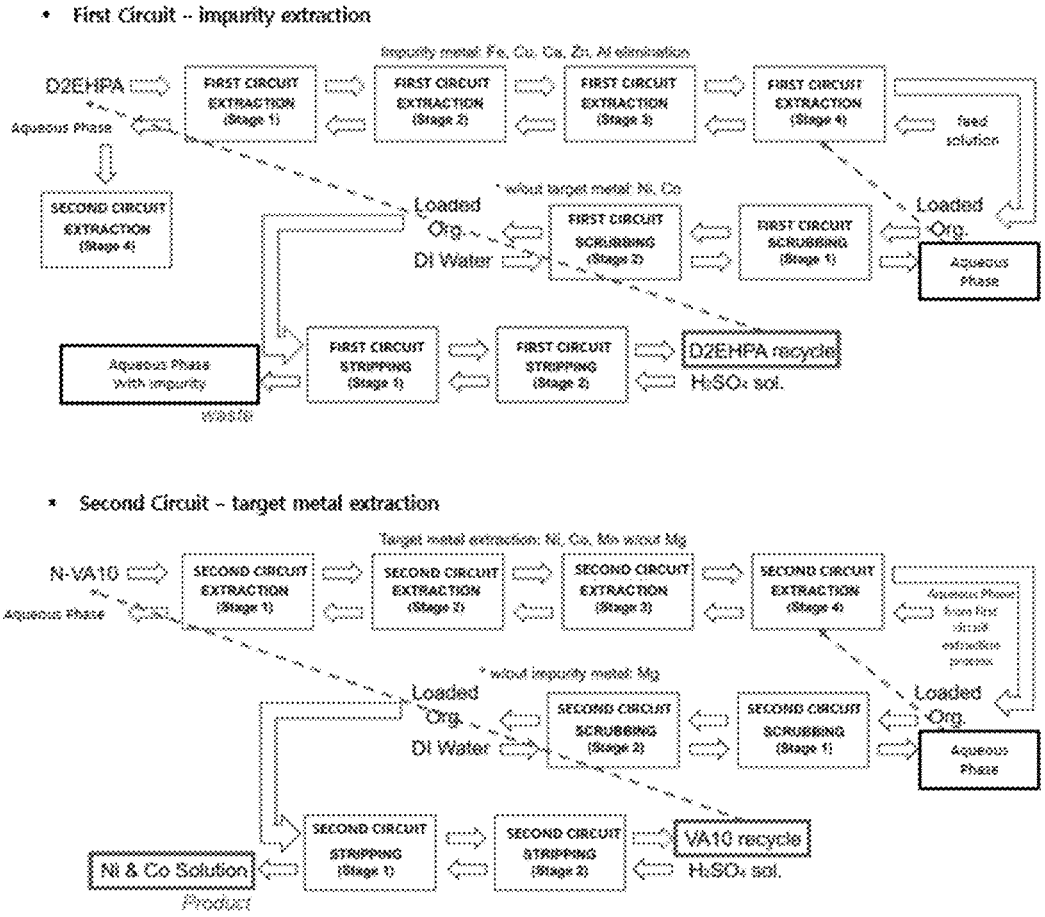
FIG. 2 is a schematic diagram showing the method for manufacturing a high-purity nickel/cobalt mixed solution for cathode materials using a two-circuit process according to an embodiment of the present invention.
Figure 3:
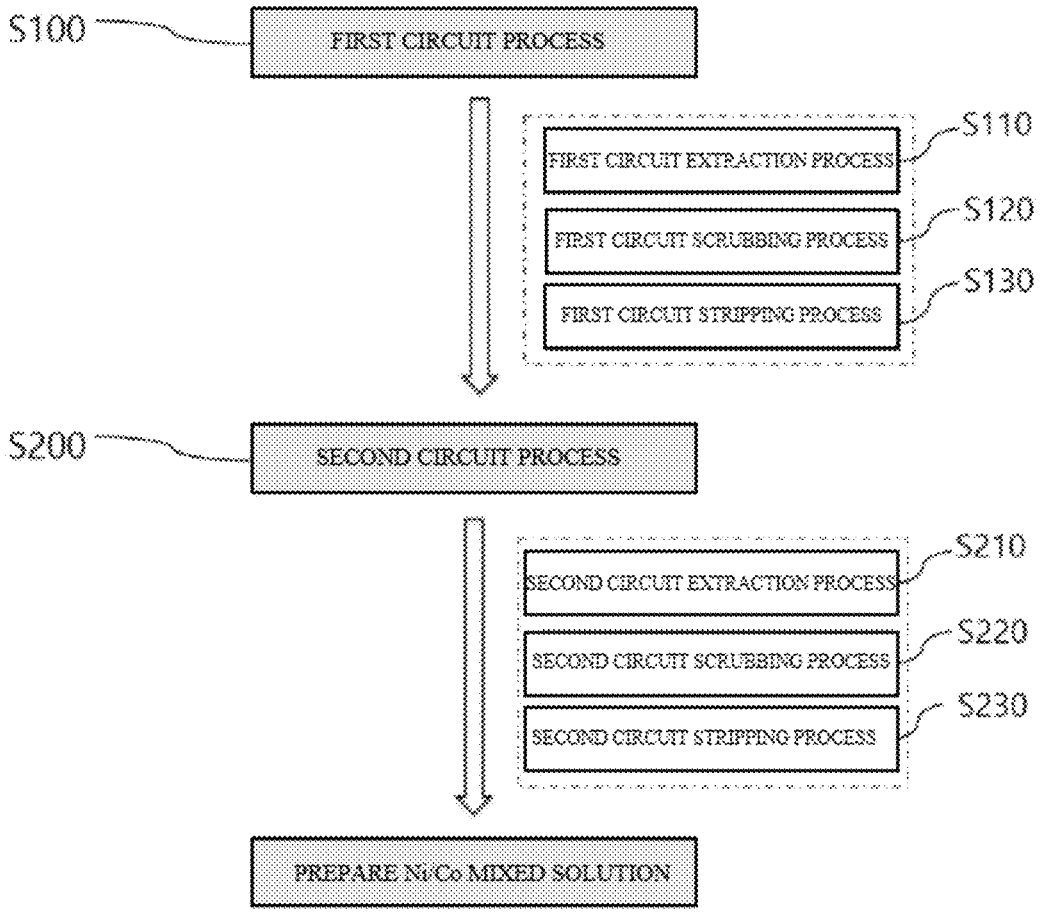
FIG. 3 is a flow chart showing the method for manufacturing a high-purity nickel/cobalt mixed solution for cathode materials using a two-circuit process according to an embodiment of the present invention.

FIG. 2 is a schematic diagram showing the method for manufacturing a high-purity nickel/cobalt mixed solution for cathode materials using a two-circuit process according to an embodiment of the present invention, and FIG. 3 is a flow chart of the method.

Referring to FIG. 2 or 3, the method for manufacturing a high-purity nickel/cobalt mixed solution for cathode materials using a two-circuit process includes a first circuit process S100 and a second circuit process S200. More specifically, the first circuit process S100 includes a first circuit extraction process S110 of extracting impurities other than magnesium in an organic phase from a sulfide containing nickel, cobalt and magnesium using a first extraction agent at a given value of pH; a first circuit scrubbing process S120 of stirring the extracted organic phase along with distilled water to recover the extracted nickel and cobalt in an aqueous phase; and a first circuit stripping process S130 of recovering the impurities contained in the first extraction agent in an aqueous phase.

The second circuit process S200 includes a second circuit extraction process S210 of saponifying a second extraction agent for separation of magnesium of the first circuit process and extracting nickel, cobalt and manganese in an organic phase; a second circuit scrubbing process S220 of stirring the organic phase from the second circuit extraction process along with distilled water and recovering the extracted magnesium in an aqueous phase; and a second circuit stripping process S230 of recovering the extracted nickel and cobalt in an aqueous phase and productizing into a mixed liquid form. A detailed description will be given as follows.

First Circuit Process

The first circuit process S100 is conducted for the purpose of isolating impurities other than magnesium from a feed solution in order to prepare a high-purity Ni/Co mixed solution for cathode materials according to an embodiment of the present invention. Further, it consists of the first circuit extraction process S110, the first circuit scrubbing process S120, and the first circuit stripping process S130.

The first circuit extraction process S110 is for extracting impurities other than magnesium in an organic phase from a sulfide containing nickel, cobalt and magnesium in the presence of a first extraction agent at a given value of pH.

The first circuit extraction process may be performed at pH 3.4 to 3.6 as adjusted by using 35 to 45 wt. % of sodium hydroxide (NaOH), preferably at pH 3.45 to 3.55 as adjusted by using 37 to 43 wt. % of sodium hydroxide (NaOH). The pH value below the range makes it difficult to extract all the impurity elements and reduces the extraction percentages of impurity metals to eventually increase the required number of extraction stages; whereas the pH value above the range causes unintended extraction of the metals of interest in a large quantity, increasing the required number of scrubbing stages in the first circuit scrubbing step.

The first circuit extraction process may be performed at an organic/aqueous (O/A) ratio of 1.7 to 1.9, preferably 1.75 to 1.85. The O/A ratio below the range increases the number of stages required for the removal of impurity elements, especially copper (Cu); whereas the O/A ratio above the range results in consuming the extraction agent in an excessive amount relative to the impurity elements.

The first extraction agent is diluted with a diluent and acts as an organic solvent. Examples of the first extraction agent may include alkyl phosphonic acid esters, such as bis(2-ethylhexyl)phosphate (D2EHPA), or mono-2-ethylhexyl (2-ethylhexyl)phosphonate (common name, PC-88 A). Preferably, the first extraction agent may be bis(2-ethylhexyl) phosphate (D2EHPA, di-2-ethylhexyl-phosphoric acid). On the other hand, the diluent is not specifically limited as long as it is capable of dissolving the extraction agent. Examples of the diluent may include naphthenic solvents or aromatic solvents.

The first circuit scrubbing process S120 is for stirring the extracted organic phase with distilled water to transfer the extracted nickel and cobalt partly loaded along with the impurities on the organic phase back into an aqueous phase which is recycled and reintroduced to the first circuit extraction process.

The first circuit scrubbing process may be performed at pH 2.9 to 3.1 as adjusted by using 25 to 35 wt. % of sulfuric acid ($H_2SO_4$), preferably at pH 2.95 to 3.05 as adjusted by using 27 to 32 wt. % of sulfuric acid ($H_2SO_4$). The pH value below the range poses a risk of recovering the extracted impurity elements into the aqueous phase and increases the required number of stages; whereas the pH value above the range makes it difficult to completely scrub the metal of interest.

The first circuit scrubbing process may be performed at an organic/aqueous (O/A) ratio of 4.9 to 5.1, preferably 4.95 to 5.05. The O/A ratio below the range increases the production of the process wastewater; whereas the O/A ratio above the range makes it difficult to completely scrub the metal of interest.

The first circuit stripping process S130 is for recovering the impurities loaded on the first extraction agent into an aqueous phase in order for the first extraction agent to be recycled to the extraction operation, thereby making the operation of the process smooth in the later step of reintroducing the first extraction agent to the first circuit extraction process.

The first circuit stripping process may use 13 to 17 wt. % of sulfuric acid ($H_2SO_4$) in the aqueous phase, preferably 14 to 16 wt. % of sulfuric acid ($H_2SO_4$) in the aqueous phase. The concentration of the sulfuric acid below the range reduces the stripping percentage and increases the required number of stripping stages; whereas the concentration of the sulfuric acid above the range poses a risk of forming precipitates of calcium sulfate to cause problems in the process.

The first circuit stripping process may be performed at an organic/aqueous (O/A) ratio of 4.9 to 5.1, preferably 4.95 to 5.05. The O/A ratio out of the range reduces the overall stripping percentages and incurs formation of precipitates to reduce the concentration of the sulfuric acid, causing problems in the process.

Second Circuit Process

Using the aqueous phase from the first circuit extraction process containing Ni, Co, Mn, and Mg removed of impurities other than Mg as a feed solution, the second circuit process S200 is performed for the purpose of isolating Mg from Ni, Co and Mn in order to prepare a high-purity Ni/Co mixed solution for cathode materials according to an embodiment of the present invention.

The second circuit extraction process S210 is for saponifying a second extraction agent for separation of magnesium of the first circuit process S100 and extracting nickel, cobalt and manganese in an organic phase.

The second circuit extraction process may be performed at pH 6.2 to 6.4 as adjusted by using 35 to 45 wt. % of sodium hydroxide (NaOH), preferably at pH 6.25 to 6.35 as adjusted by using 37 to 43 wt. % of sodium hydroxide (NaOH). The pH value below the range makes it difficult to completely extract the metals of interest; whereas the pH value above the range increases the risk of incurring unintended extraction of magnesium. On top of this, the sodium hydroxide may be used to adjust the pH of the extraction agent.

The second circuit extraction process may be performed at an organic/aqueous (O/A) ratio of 3.7 to 3.8, preferably 3.73 to 3.76. The O/A ratio below the range increases the number of stages necessary to the extraction of the metals of interest, especially cobalt (Co); whereas the O/A ratio above the range results in consuming the extraction agent in an excessive amount relative to the metals of interest.

The second extraction agent may be versatic acid (VA10, Versatic Acid-10), which is characterized by high selectivity for nickel (Ni) extraction through saponification.

The second circuit scrubbing process S220 is for stirring the organic phase from the second circuit extraction process along with distilled water and transferring the extracted magnesium back to the aqueous phase which is recycled and reintroduced to the second circuit extraction process.

The second circuit scrubbing process may be performed at pH 6.1 to 6.3, preferably at pH 6.15 to 6.25. This process is conducted at the initial pH of around 6.2 that is provided by adding no adjuster solution. The pH value out of the range causes the metals of interest to be scrubbed again.

The second circuit scrubbing process may be performed at an organic/aqueous (O/A) ratio of 4.9 to 5.1, preferably 4.95 to 5.05. The O/A ratio below the range increases the production of the process wastewater; whereas the O/A ratio above the range makes it difficult to completely scrub magnesium (Mg).

The second circuit stripping process S230 is not only for recovering the organic phase containing the extracted metals of interest, Ni and Co, to the aqueous phase, but for conducting concentration through adjustment of the O/A ratio to achieve productization into a mixed liquid form. In addition, this process is also performed for the recycling of the second extraction agent through the recovery of the elements loaded on the second extraction agent.

The second circuit stripping process may use 25 to 35 wt. % of sulfuric acid ($H_2SO_4$) with an organic/aqueous (O/A)

ratio of 4.9 to 5.1. Within the ranges, it is possible to prevent a reduction of stripping percentages and make the process operations smooth.

In the second circuit stripping process, the process temperature may be 55 to 65 °C, preferably 57 to 62 °C. The process temperature within the defined range has an effect to reduce the formation of reddish brown precipitates that may occur during the process at the room temperature.

As described above, the method for manufacturing a high-purity Ni/Co mixed solution for cathode materials by using a two-circuit process according to an embodiment of the present invention skips a crystallization process unlike the conventional three-circuit process of impurity extraction, cobalt (Co) extraction and nickel (Ni) extraction and adopts a two-circuit process to extract cobalt and nickel in a simultaneous manner and produce a Ni/Co mixed solution, so it is advantageously possible to reduce the investment cost for the manufacturing process, downsize mixer-settler facilities, thus maximizing the efficiency of site utilization, and realize eco-friendly effects, such as reducing the consumption of adjuster solutions and cutting down the process costs and the process wastewater production.

Hereinafter, a further detailed description will be given as to the configurations and functions of the present invention with reference to the preferred embodiments of the present invention, which are given for illustration of the preferable examples of the present invention and should be construed to not limit the scope of the present invention.

Contents not described in this disclosure can be technically inferred sufficiently by those skilled in the art and the description thereof will be omitted.

EXAMPLES

Example 1

In the first circuit extraction process, D2EHPA as an extraction agent was diluted with the hydrotreated kerosene ISD-159 to a concentration of 21% in order to extract impurities such as Fe, Cu, Ca, Zn, and Al other than Mg in the organic phase. The pH was adjusted to approximately 3.5 using 40 wt. % of NaOH as a pH adjuster solution. In this regard, the process had an organic/aqueous (O/A) ratio of approximately 1.8 and consisted of four stages, i.e., three theoretical stages as determined by the McCabe-Thiele diagram plus one experimental extra stage.

Subsequently, in the first circuit scrubbing process, the organic phase containing the metals of interest (Ni and Co) extracted in the first circuit extraction process was stirred along with distilled water to recover the metals of interest in an aqueous phase. The pH was adjusted to approximately 3 using 30 wt. % of sulfuric acid as a pH adjuster solution. The process had an organic/aqueous (O/A) ratio of approximately 5 and consisted of two stages, i.e., one theoretical stage as determined by the McCabe-Thiele diagram plus one experimental extra stage.

In the first circuit stripping process, impurity elements contained in the extraction agent were recovered in the aqueous phase in order to allow the extraction agent to be recycled later. The stripping process used 15 wt. % of sulfuric acid for the aqueous phase and consisted of two stages with an O/A ratio of 5.

In the second circuit extraction process, VA-10 as an extraction agent was diluted with ISD-159 to a concentration of 40% and saponified to extract Ni, Co, and Mn in the organic phase, in order to isolate Mg that was not separated in the first circuit process. The pH was adjusted to approximately 6.3 using 40 wt. % of NaOH as a pH adjuster solution. The process had an organic/aqueous (O/A) ratio of approximately 3.75 and consisted of four stages, i.e., three theoretical stages as determined by the McCabe-Thiele diagram plus one experimental extra stage.

Subsequently, in the second circuit scrubbing process, the organic phase after extraction was stirred along with distilled water to recover Mg extracted during the second circuit extraction process into the aqueous phase. The process was performed without using any pH adjuster solution and hence operated at the initial pH of 6.2. The process had an organic/aqueous (O/A) ratio of approximately 5 and consisted of two theoretical stages as determined by the McCabe-Thiele diagram.

In the second circuit stripping process, the extracted metals of interest were recovered to the aqueous phase and productized into a mixed liquid form. The stripping process used 30 wt. % of sulfuric acid for the aqueous phase and consisted of one to two stages with an O/A ratio of around 5. In this regard, the process temperature was about 60 °C. The final product thus obtained was the high-purity nickel/cobalt mixed solution for cathode materials prepared by a two-circuit process according to an embodiment of the present invention.

Comparative Example 1

The procedures were performed in the same manner as described in Example 1, excepting that the first circuit stripping process had an O/A ratio of around 10, to prepare a high-purity nickel/cobalt mixed solution for cathode materials.

TABLE 1

| | Element | Single-stage |
|---|---|---|
| Concentration (g/L) | Ni | 136.60 |
| | Co | 10.00 |
| | Mn | 3.65 |
| Impurities (ppm) | Na | 87.11 |
| | Mg | 11.11 |
| | Al | N/D |
| | Ca | 2.27 |
| | Fe | N/D |
| | Cu | 74.50 |
| | Zn | N/D |
| | Li | N/D |

TABLE 2

| Yield (%) | Ni | Co | Mn |
|---|---|---|---|
| First-circuit extraction | 98.78 | 78.82 | 16.25 |
| Second-circuit extraction | 94.09 | 86.55 | 100.00 |
| Second-circuit scrubbing | 98.80 | 97.00 | 100.00 |
| Second-circuit stripping | 99.99 | 100.00 | 99.96 |
| Single-stage yield | 91.83 | 66.17 | 16.25 |

TABLE 3

| Yield (%) | Ni | Co | Mn |
|---|---|---|---|
| Multi-stage yield | 99.97 | 99.08 | 32.82 |

The high-purity nickel/cobalt mixed solution for cathode materials using a two-circuit process was prepared according to an embodiment of the present invention as described above. The results, including the yields, are presented in Tables 1, 2 and 3 and FIGS. 4 to 17.

Figure 4:
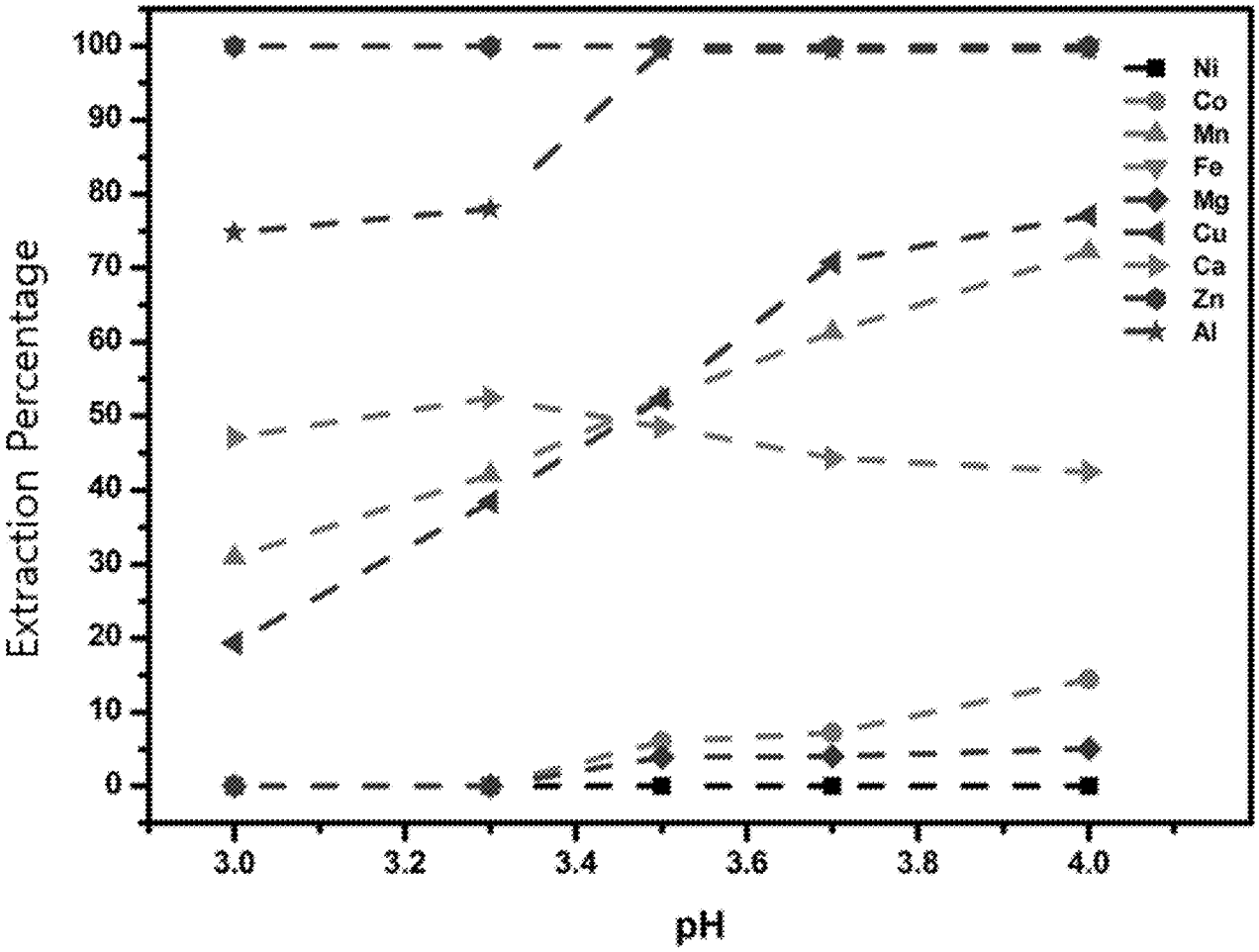
FIG. 4 is an extraction percentage-pH diagram of the first circuit extraction process in the method for manufacturing a high-purity nickel/cobalt mixed solution for cathode materials according to an embodiment of the present invention.

FIG. 4 is an extraction percentage-pH diagram of the first circuit extraction process in the method for manufacturing a high-purity nickel/cobalt mixed solution for cathode materials according to an embodiment of the present invention.

Referring to FIG. 4, as much of the metals of interest, Ni and Co, were transferred to the organic phase in the first circuit extraction process, it was required to increase the number of scrubbing stages due to the increased amounts of the metals of interest to be scrubbed. Accordingly, the pH for the process was set to 3.5 at which the metals of interest were partly extracted.

Figure 5:
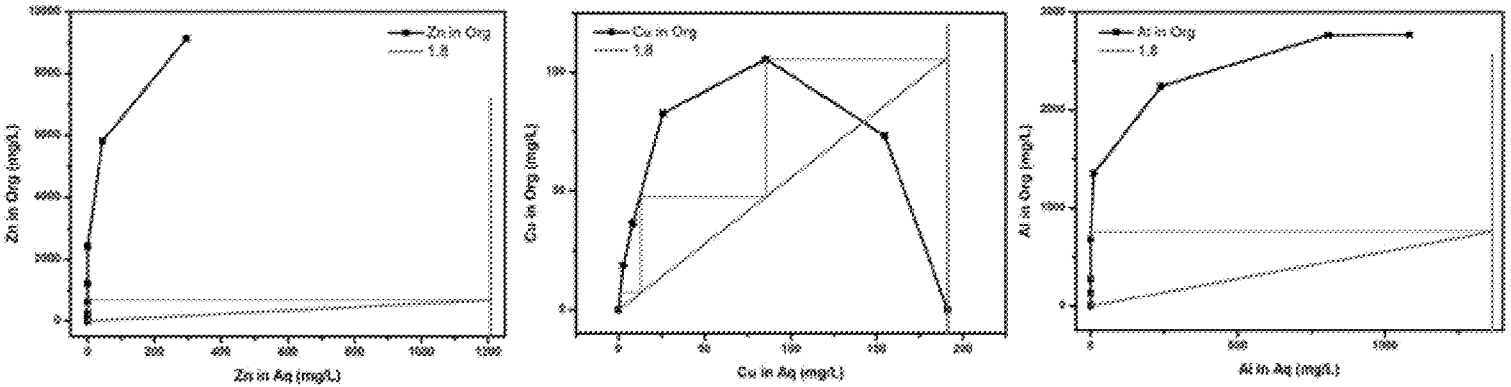
FIG. 5 is a McCabe-Thiele diagram of the first circuit extraction process in the method for manufacturing a high-purity nickel/cobalt mixed solution for cathode materials according to an embodiment of the present invention.

FIG. 5 is a McCabe-Thiele diagram of the first circuit extraction process in the method for manufacturing a high-purity nickel/cobalt mixed solution for cathode materials according to an embodiment of the present invention.

Referring to FIG. 5, it can be seen that the conditions of the other elements were adjusted to those of copper (Cu) with a lowest extraction percentage, because copper occasionally remained unextracted while zinc (Zn) or aluminum (Al) with relatively high extraction percentages were completely extracted after a specific number of extraction stages. In the McCabe-Thiele diagram for Cu extraction, the O/A ratio, i.e., the slope formed by taking a point on the vertical line so that it has the same height as the highest point of the arcuate Cu curve was 1.8, and the number of stages required for complete extraction of Cu was 3 (which was the theoretical number of stages). Yet, the actual process may not achieve the complete extraction of Cu, so one or two extra stages were additionally arranged.

Figure 6:
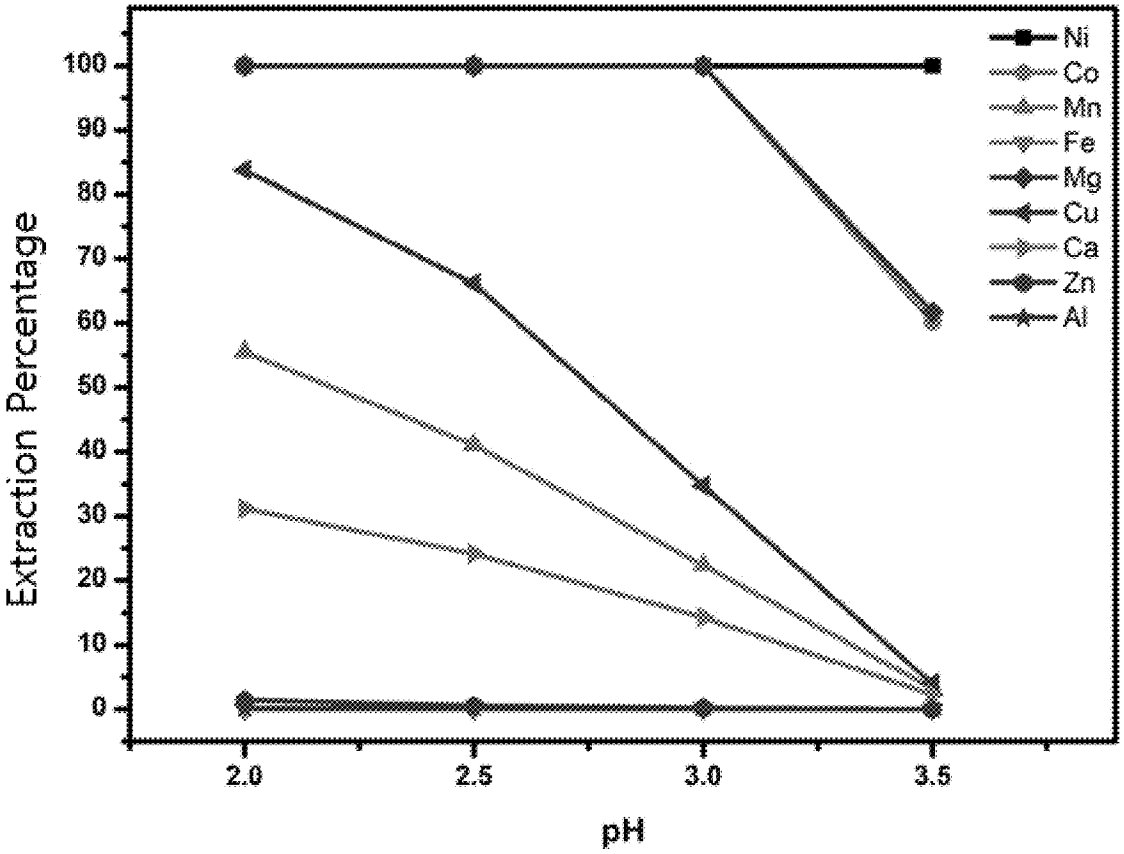
FIG. 6 is an extraction percentage-pH diagram of the first circuit scrubbing process in the method for manufacturing a high-purity nickel/cobalt mixed solution for cathode materials according to an embodiment of the present invention.

FIG. 6 is an extraction percentage-pH diagram of the first circuit scrubbing process in the method for manufacturing a high-purity nickel/cobalt mixed solution for cathode materials according to an embodiment of the present invention.

Referring to FIG. 6, it was necessary to recover the Ni and Co extracted together in the first circuit extraction process. The first circuit scrubbing process was thus performed to transfer the Ni and Co contained in the organic phase down back to the aqueous phase by adjustment of the pH to 3.0 through scrubbing the metals of interest and reducing the concentration of the impurities.

Figure 7:
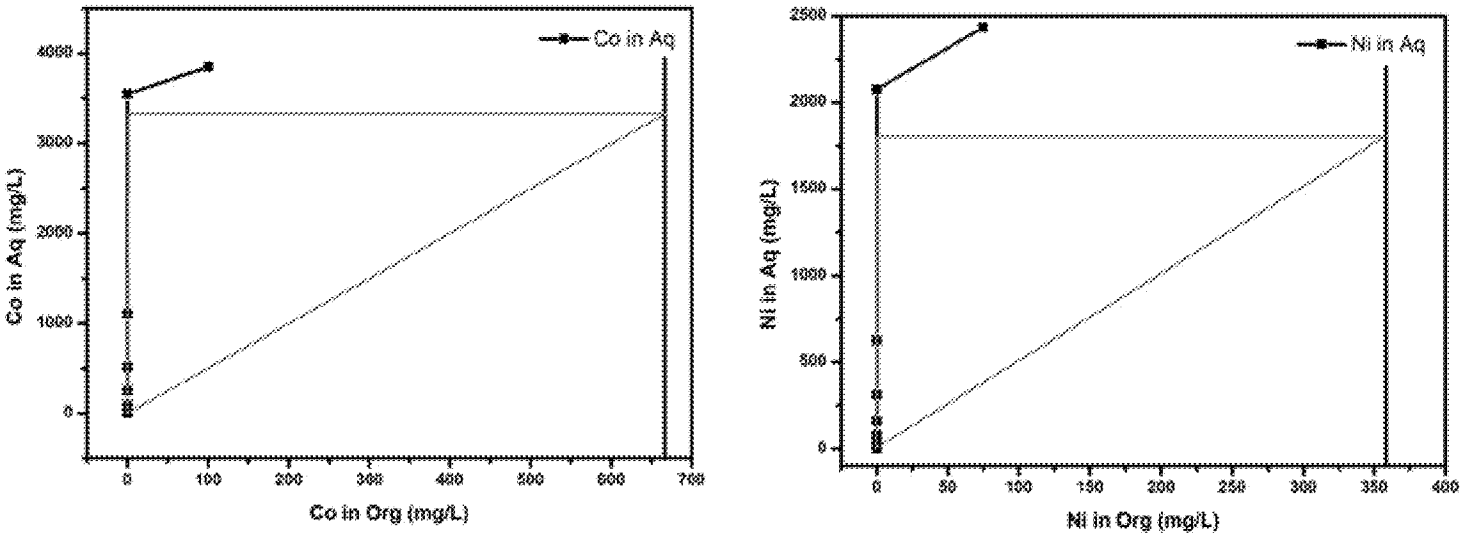
FIG. 7 is a McCabe-Thiele diagram of the first circuit scrubbing process in the method for manufacturing a high-purity nickel/cobalt mixed solution for cathode materials according to an embodiment of the present invention.

FIG. 7 is a McCabe-Thiele diagram of the first circuit scrubbing process in the method for manufacturing a high-purity nickel/cobalt mixed solution for cathode materials according to an embodiment of the present invention.

Referring to FIG. 7, with a slope line (O/A=5) drawn in the first circuit scrubbing process, the theoretical number of stages was one. Hence, the process consisted of two stages in total, i.e., one theoretical stage plus one extra stage.

Figure 8:
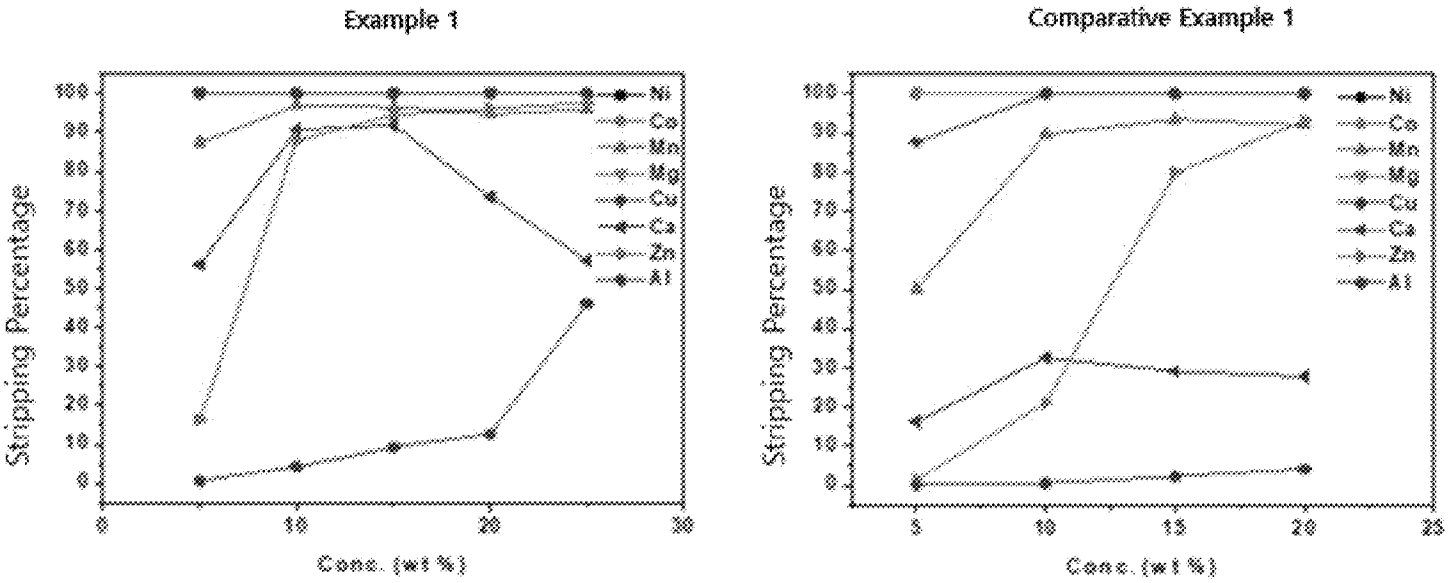
FIG. 8 is a graph showing the stripping percentage as a function of sulfuric acid concentration of the first circuit stripping process in the method for manufacturing a high-purity nickel/cobalt mixed solution for cathode materials according to an embodiment of the present invention.

FIG. 8 is a graph showing the stripping percentage as a function of sulfuric acid concentration of the first circuit stripping process in the method for manufacturing a high-purity nickel/cobalt mixed solution for cathode materials according to an embodiment of the present invention.

Referring to FIG. 8, as in Example 1 according to an embodiment of the present invention, when the stripping percentage as a function of the sulfuric acid concentration in the first circuit stripping process was given by O/A=5, no precipitate occurred at the sulfuric acid concentration of 15 wt. % and the stripping percentages for all the elements other than Al were 90% or above; therefore, the process conditions were set as O/A=5 with 15 wt. % of sulfuric acid. As aluminum (Al) was sufficiently removed in the leaching step prior to the solvent extraction and hard to desorb, a minimum amount of Al could be introduced in the solvent extraction step. When Al accumulated in the extraction agent after a cycle of the first circuit process exceeded a certain concentration, an acid treatment was conducted to remove Al. It was therefore possible to continuously recycle the extraction agent (D2EHPA) by adjusting the composition of the feed solution or conducting an additional stripping process. In contrast, as in Comparative Example 1, the first circuit stripping process with O/A=10 resulted in producing precipitates of calcium sulfate at a sulfuric acid concentration above 15 wt. %. If the process was set to have a sulfuric acid concentration of 10 wt. % at which no precipitate occurred, the stripping percentages for Zn and Ca became too low, causing a risk of increasing the required number of stripping stages. It is therefore desirable to set the process conditions as O/A=5 and a sulfuric acid concentration of 10 to 15 wt. % in the first circuit stripping process.

Figure 9:
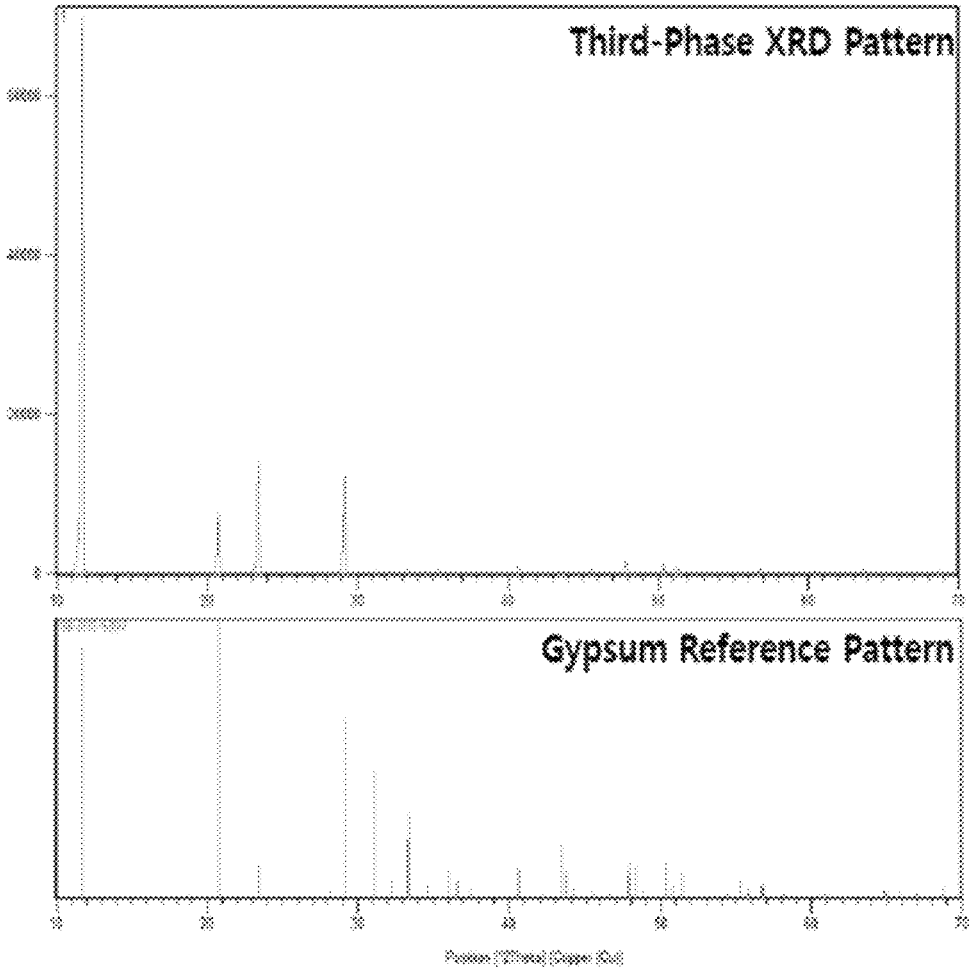
FIG. 9 is a graph showing the XRD patterns of the precipitate produced by the first circuit stripping process in the method for manufacturing a high-purity nickel/cobalt mixed solution for cathode materials according to an embodiment of the present invention.
Figure 10:
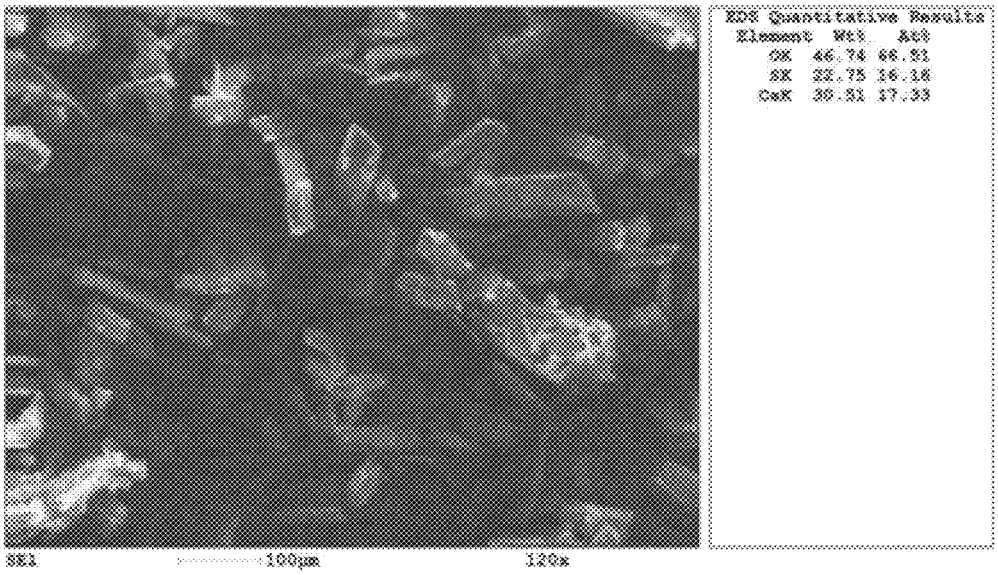
FIG. 10 is an EDS analytical graph of the precipitate produced by the first circuit stripping process in the method for manufacturing a high-purity nickel/cobalt mixed solution for cathode materials according to an embodiment of the present invention.
Figure 10:
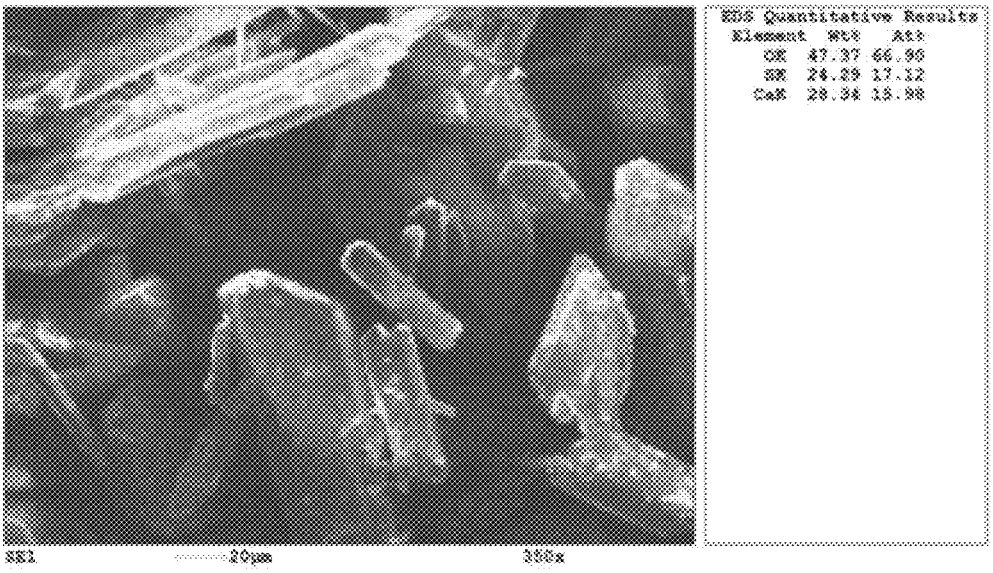

FIG. 9 is a graph showing the XRD patterns of the precipitate produced by the first circuit stripping process in the method for manufacturing a high-purity nickel/cobalt mixed solution for cathode materials according to an embodiment of the present invention, and FIG. 10 is an EDS analytical graph of the precipitate.

Referring to FIGS. 9 and 10, the component of the precipitate produced by the first circuit process according to an embodiment of the present invention was calcium sulfate. Calcium not measured in the stripping process was precipitated into a solid form and its amount was not measurable.

Figure 11:
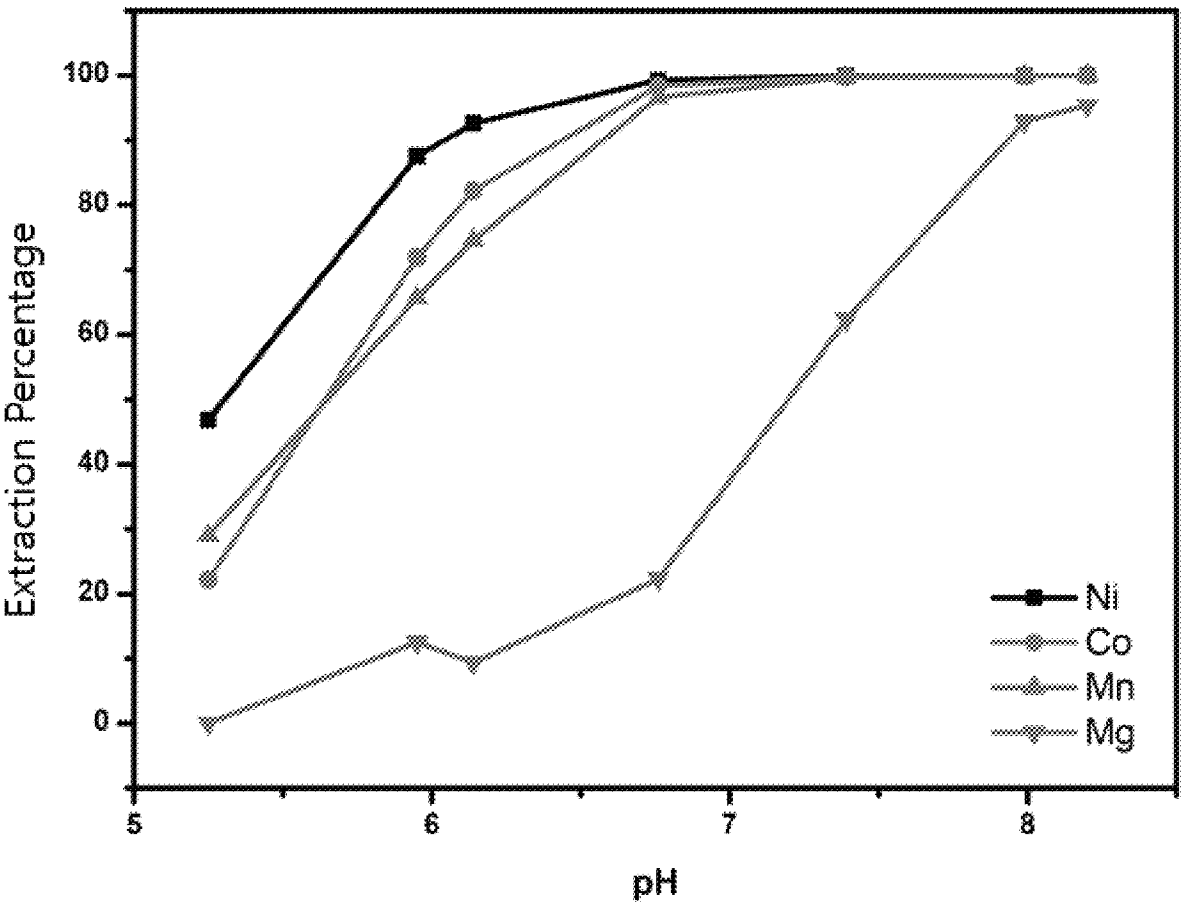
FIG. 11 is an extraction percentage-pH diagram of the second circuit extraction process in the method for manufacturing a high-purity nickel/cobalt mixed solution for cathode materials according to an embodiment of the present invention.

FIG. 11 is an extraction percentage-pH diagram of the second circuit extraction process in the method for manufacturing a high-purity nickel/cobalt mixed solution for cathode materials according to an embodiment of the present invention.

Referring to FIG. 11, the second circuit extraction process was performed to extract metals of interest such as Ni, Co, and Mn in the organic phase and isolate Mg as an impurity in the aqueous phase. For the sake of adjusting the number of stages and reducing impurities, the pH for the process was preferably set to 6.3, at which sufficient extraction occurred for the metals of interest other than Mg.

Figure 12:
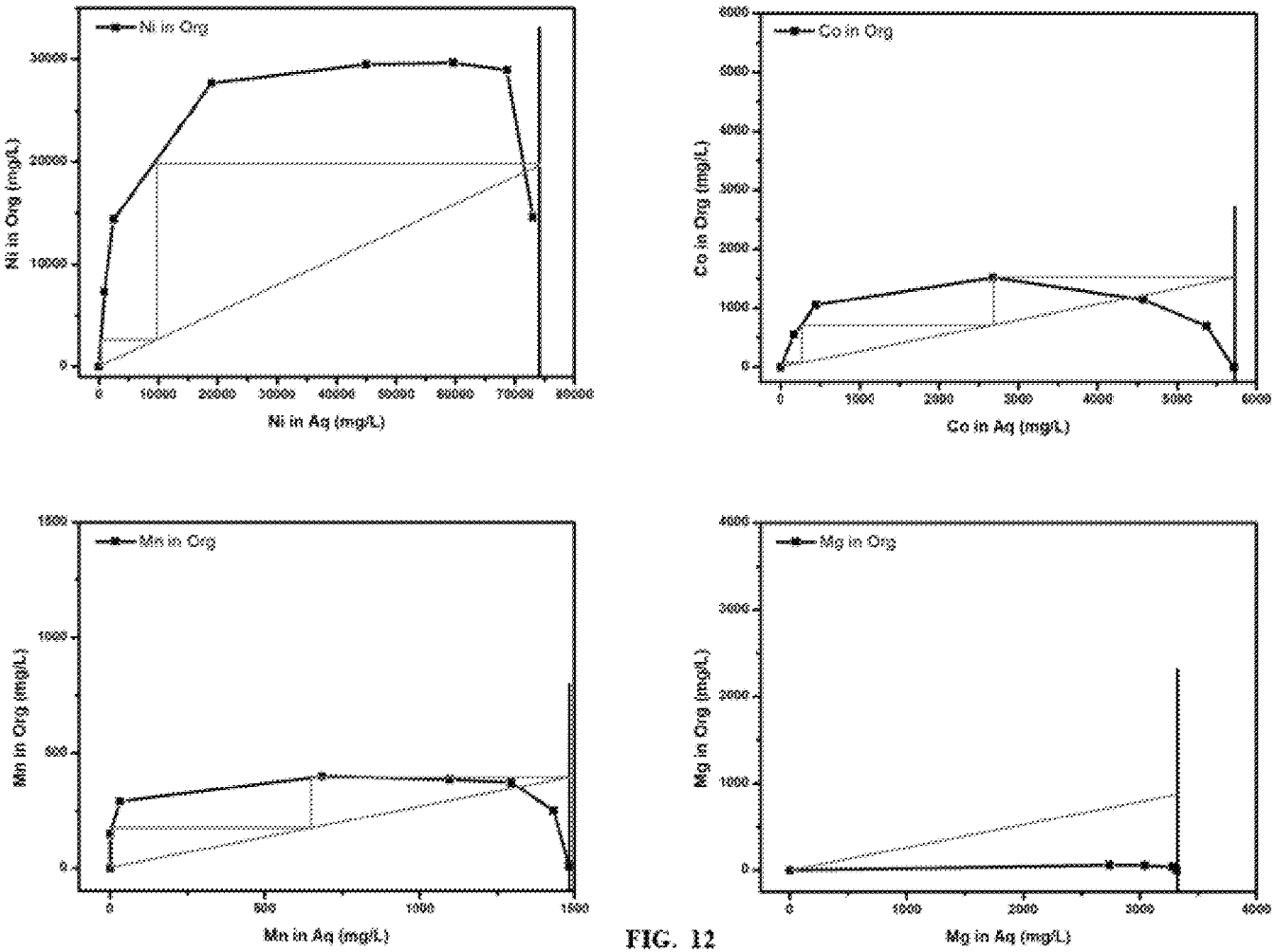
FIG. 12 is a McCabe-Thiele diagram of the second circuit extraction process in the method for manufacturing a high-purity nickel/cobalt mixed solution for cathode materials according to an embodiment of the present invention.

FIG. 12 is a McCabe-Thiele diagram of the second circuit extraction process in the method for manufacturing a high-purity nickel/cobalt mixed solution for cathode materials according to an embodiment of the present invention.

Referring to FIG. 12, the required number of stages for the second circuit extraction process was determined with reference to cobalt (Co) that required the highest number of stages according to the McCabe-Thiele diagram. Hence, the second circuit extraction process was designed to have an O/A ratio of 3.75 in consideration of the slope and operated with four extraction stages, i.e., three theoretical stages plus one extra stage.

Figure 13:
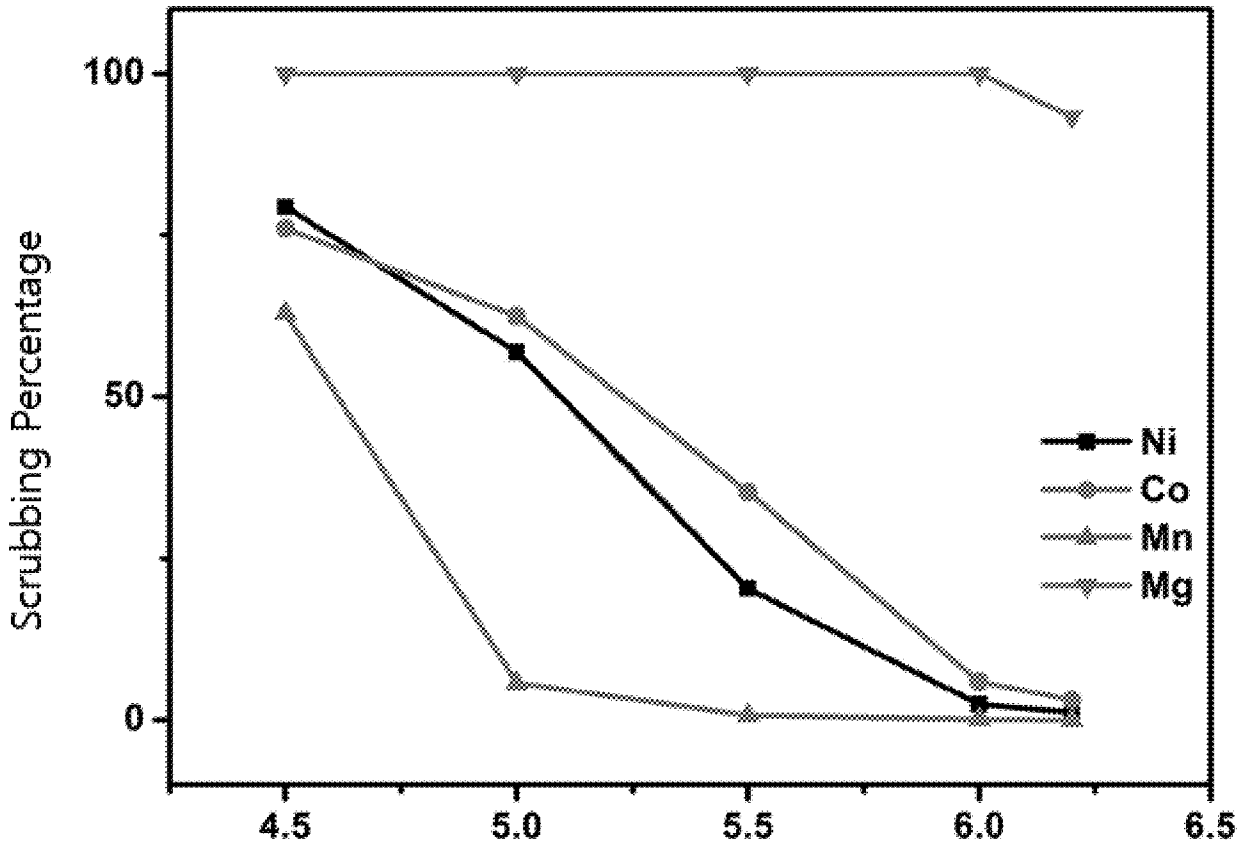
FIG. 13 is an scrubbing percentage-pH diagram of the second circuit scrubbing process in the method for manufacturing a high-purity nickel/cobalt mixed solution for cathode materials according to an embodiment of the present invention.

FIG. 13 is an scrubbing percentage-pH diagram of the second circuit scrubbing process in the method for manufacturing a high-purity nickel/cobalt mixed solution for cathode materials according to an embodiment of the present invention.

Referring to FIG. 3, the second circuit scrubbing process was operated for re-scrubbing the extracted impurity element, Mg, and the pH for the process was set to 6.2, at which Mg may be almost completely scrubbed.

Figure 14:
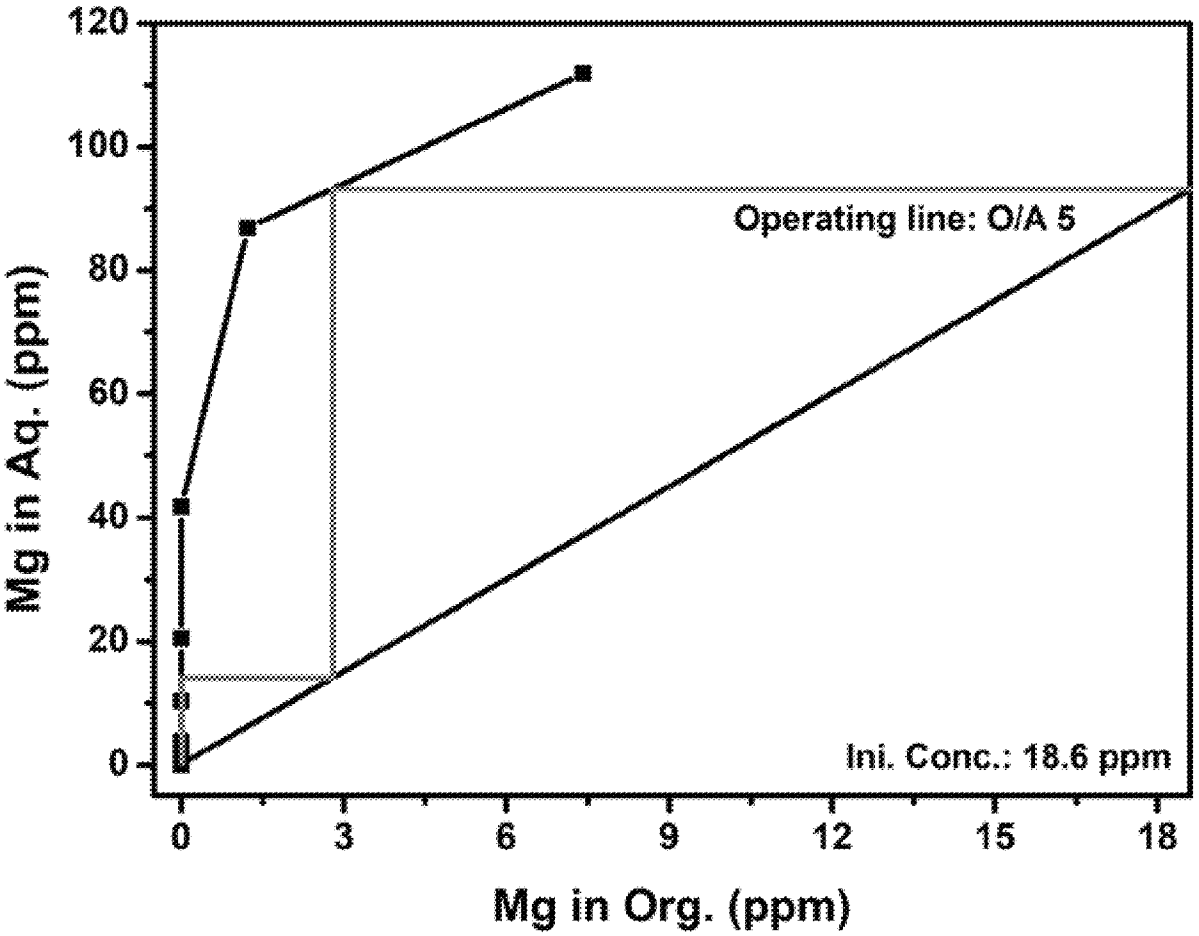
FIG. 14 is a McCabe-Thiele diagram of the second circuit scrubbing process in the method for manufacturing a high-purity nickel/cobalt mixed solution for cathode materials according to an embodiment of the present invention.

FIG. 14 is a McCabe-Thiele diagram of the second circuit scrubbing process in the method for manufacturing a high-purity nickel/cobalt mixed solution for cathode materials according to an embodiment of the present invention.

Referring to FIG. 14, the second circuit scrubbing process consisted of two scrubbing stages, i.e., two theoretical stages as determined by the McCabe-Thiele diagram plus no extra stage due to the slope being almost vertical at the point of the low O/A for Mg.

Figure 15:
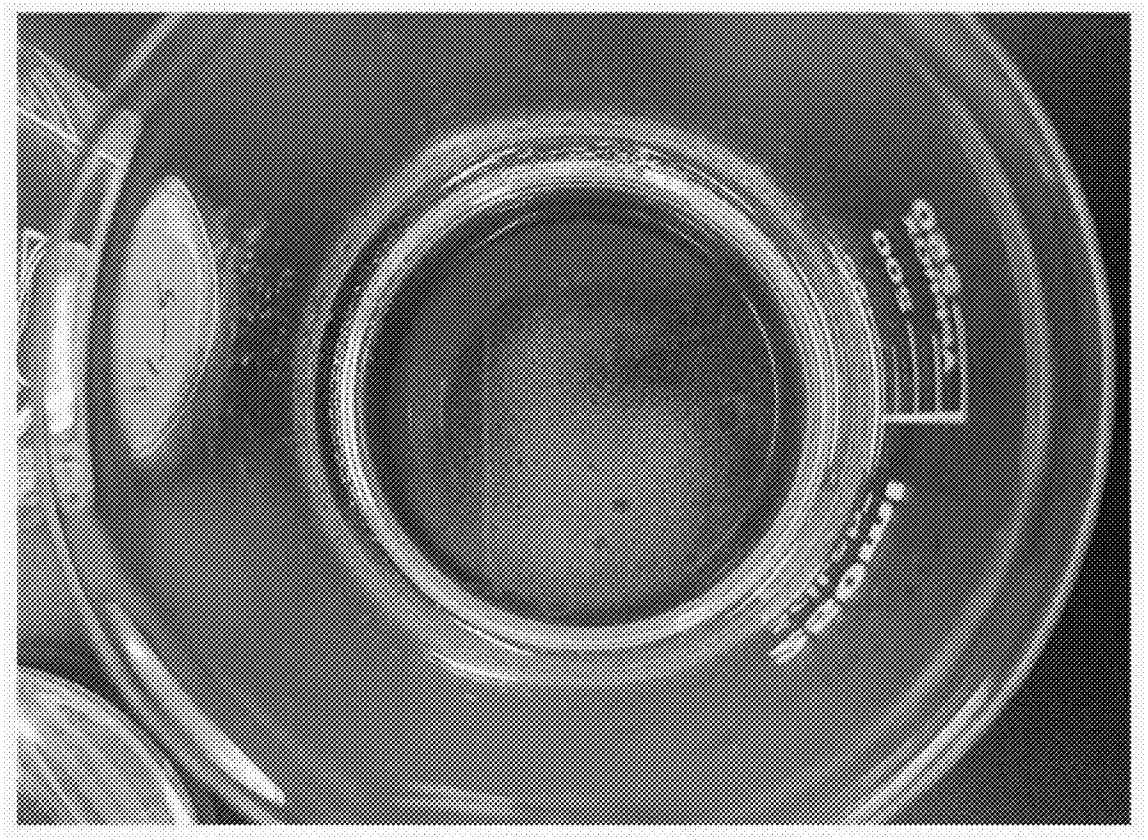
FIG. 15 is a picture of the precipitate produced by the second circuit scrubbing process in the method for manufacturing a high-purity nickel/cobalt mixed solution for cathode materials according to an embodiment of the present invention.

FIG. 15 is a picture of the precipitate produced by the second circuit scrubbing process in the method for manufacturing a high-purity nickel/cobalt mixed solution for cathode materials according to an embodiment of the present invention.

Referring to FIG. 15, in the second circuit scrubbing process of the present invention, a film-like reddish brown precipitate occurred at the room temperature and its production decreased at an elevated temperature of 60 C.

Figure 16:
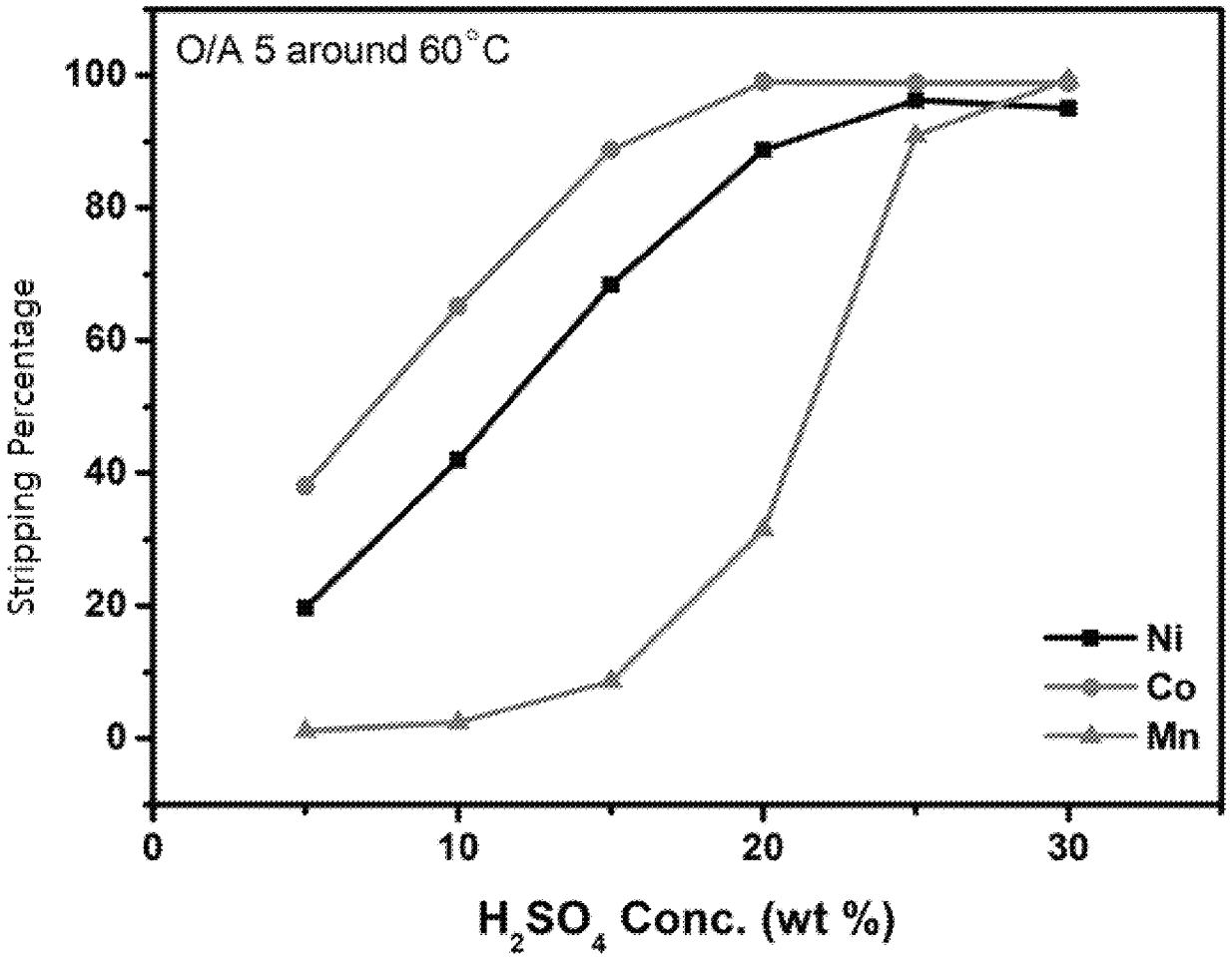
FIG. 16 is a graph showing the stripping percentage as a function of sulfuric acid concentration of the second circuit stripping process in the method for manufacturing a high-purity nickel/cobalt mixed solution for cathode materials according to an embodiment of the present invention.

FIG. 16 is a graph showing the stripping percentage as a function of sulfuric acid concentration of the second circuit stripping process in the method for manufacturing a high-purity nickel/cobalt mixed solution for cathode materials according to an embodiment of the present invention.

Referring to FIG. 16, the second circuit stripping process was operated to strip the metals of interest almost completely in a single stage at the sulfuric acid concentration of 30 wt. %. Yet, the actual process may have some of the metals of interest remaining not stripped and is thus designed to operate with up to two stripping stages. Accordingly, the required number of stages for the stripping process may be preferably 1 or 2.

Figure 17:
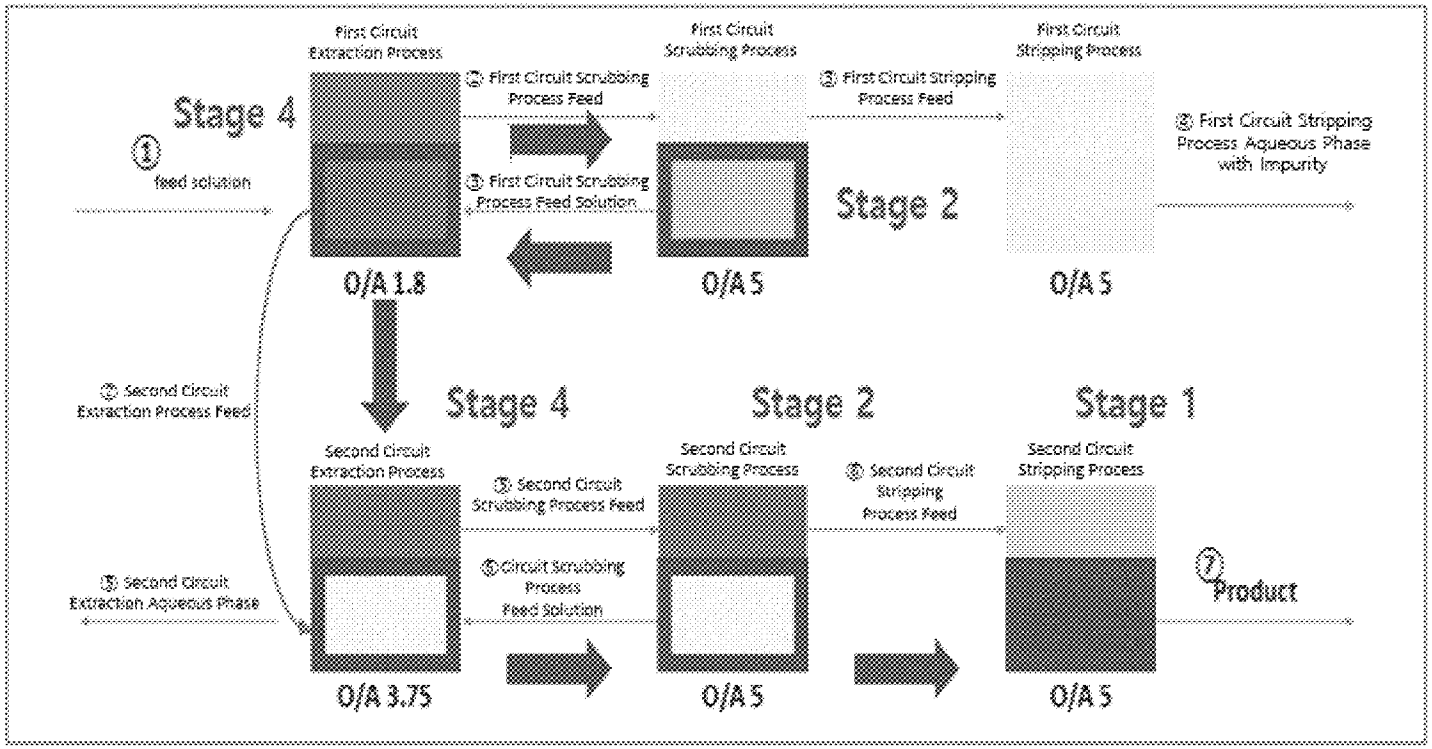
FIG. 17 is a schematic diagram calculating the yield by using the number of process stages in a McCabe-Thiele plot for manufacturing a high-purity nickel/cobalt mixed solution for cathode materials according to an embodiment of the present invention.

FIG. 17 is a schematic diagram calculating the yield by using the number of process stages in a McCabe-Thiele plot for manufacturing a high-purity nickel/cobalt mixed solution for cathode materials according to an embodiment of the present invention. Table 1 presents the specification of the product obtained when each of the processes consists of a single stage; Table 2 shows the yields of metals of interest; and Table 3 presents the yields of the multi-stage processes each consisting of the required number of stages calculated from the graphical McCabe-Thiele method.

Referring to FIG. 17 and Table 1, 2 and 3, among other metals of interest, manganese (Mn) is relatively inexpensive and the cost of increasing the yield of Mn is greater than the sales profit, so it may not be recommendable to separate all the amount of Mn in the solution. In this regard, a single-stage process had a lot of impurity elements such as Cu and Mg remain not separated, which led to relatively low yields of metals of interest such as Ni and Co. On the flip side, in a multi-stage process using the required number of stages according to the McCabe-Thiele diagram, the first circuit extraction process operated with four extraction stages effectively removed Cu impurities to a quantity of 3 ppm or less, and the first circuit scrubbing process recovered all the extracted Ni and Co. In addition, Ni and Co were insufficiently extracted in a single extraction stage of the second circuit extraction process, while they were all extracted through four extraction stages of the second circuit extraction process. The Mg impurity extracted was also sufficiently removed in the second circuit scrubbing process. In other words, the use of the multi-stage process designed by quantitative calculation of the required number of stages according to the McCabe-Thiele diagram notably resulted in high yields.

As described above, the method for manufacturing a high-purity nickel/cobalt mixed solution for cathode materials by using a two-circuit process that skips the crystallization process unlike the conventional three-circuit process of impurity extraction, cobalt (Co) extraction and nickel (Ni) extraction and adopts a two-circuit process to extract cobalt and nickel in a simultaneous manner and prepare a nickel/cobalt mixed solution, thereby reducing the investment cost for the manufacturing process, downsizing mixer-settler facilities to maximize the efficiency of site utilization, and realizing eco-friendly effects, such as reducing the consumption of adjuster solutions and cutting down the process costs and the production of process wastewater.

Although the exemplary embodiments of the present invention have been described with reference to limited embodiments and drawings, it is understood that the present invention should not be limited to these exemplary embodiments but various changes and modifications can be made by one ordinary skilled in the art.

Accordingly, the scope of the present invention should not be defined by these embodiments but by the following claims and equivalents to the claims.

DESCRIPTION OF REFERENCE NUMERALS

S100: First circuit process
S110: First circuit extraction process
S120: First circuit scrubbing process
S130: First circuit stripping process
S200: Second circuit process
S210: Second circuit extraction process
S220: Second circuit scrubbing process
S230: Second circuit stripping process

What is claimed is:

1. A method for manufacturing a nickel/cobalt mixed solution for cathode material by a two-circuit process, the method comprising:

(a) a first circuit extraction process of extracting impurities other than magnesium from a sulfide containing nickel, cobalt and magnesium using a first extraction agent at a given value of pH resulting in an extracted organic phase;

(b) a first circuit scrubbing process of stirring the extracted organic phase along with distilled water to recover the nickel and cobalt extracted from the first circuit extraction process in an aqueous phase;

(c) a first circuit stripping process of recovering the impurities including calcium contained in the first extraction agent in an aqueous phase to regenerate the first extraction agent for recycling to the first circuit extraction process;

(d) a second circuit extraction process of saponifying a second extraction agent for separation of magnesium of the first circuit process and extracting nickel, cobalt and manganese in an organic phase;

(e) a second circuit scrubbing process of stirring the organic phase from the second circuit extraction process along with distilled water and recovering the magnesium extracted from the second circuit extraction process in an aqueous phase; and (f) a second circuit stripping process of recovering the extracted nickel and cobalt in an aqueous phase and productizing into a mixed liquid form, wherein the first circuit stripping process of (c) is performed using sulfuric acid ($H_2SO_4$) in an aqueous phase at a concentration of 10 to 15 wt. %, with an organic/aqueous (O/A) ratio being 4.9 to 5.1, the concentration of 10 to 15 wt. % being selected to suppress formation of a calcium sulfate precipitate during the first circuit stripping process.

2. The method according to claim 1, wherein the first circuit extraction process of (a) is performed at pH 3.4 to 3.6, with an organic/aqueous (O/A) ratio being 1.7 to 1.9.

3. The method according to claim 1, wherein the first circuit scrubbing process of (b) is performed at pH 2.9 to 3.1, with an organic/aqueous (O/A) ratio being 4.9 to 5.1.

4. The method according to claim 1, wherein the second circuit extraction process of (d) is performed at pH 6.2 to 6.4, with an organic/aqueous (O/A) ratio being 3.7 to 3.8.

5. The method according to claim 1, wherein the second circuit scrubbing process of (e) is performed at pH 6.1 to 6.3, with an organic/aqueous (O/A) ratio being 4.9 to 5.1.

6. The method according to claim 1, wherein the second circuit stripping process of (f) is performed using 25 to 35 wt. % of sulfuric acid ($H_2SO_4$) in an aqueous phase, with an organic/aqueous (O/A) ratio being 4.9 to 5.1.

7. The method according to claim 6, wherein the second circuit stripping process of (f) is performed at a process temperature of 55 to 65 °C.

8. The method according to claim 1, wherein the first extraction agent is bis(2-ethylhexyl)phosphate (D2EHPA, di-2-thylhexyl-phosphoric acid), and the second extraction agent is Versatic Acid-10 (VA-10).

* * * * *